US008653396B2

(12) United States Patent
Li et al.

(10) Patent No.: US 8,653,396 B2
(45) Date of Patent: Feb. 18, 2014

(54) VACUUM SWITCH AND HYBRID SWITCH ASSEMBLY THEREFOR

(75) Inventors: Wangpei Li, Horseheads, NY (US); Stephen David Mayo, Horseheads, NY (US); Martin Leusenkamp, Hengelo (NL); Shaojie Ye, Jiangsu (CN)

(73) Assignee: Eaton Corporation, Cleveland, OH (US)

( * ) Notice: Subject to any disclaimer, the term of this patent is extended or adjusted under 35 U.S.C. 154(b) by 245 days.

(21) Appl. No.: 13/247,238

(22) Filed: Sep. 28, 2011

(65) Prior Publication Data

US 2013/0075369 A1 Mar. 28, 2013

(51) Int. Cl.
*H01H 33/66* (2006.01)

(52) U.S. Cl.
USPC ..... 218/126; 218/34; 218/130

(58) Field of Classification Search
USPC ..... 218/126–129, 34, 130
See application file for complete search history.

(56) References Cited

U.S. PATENT DOCUMENTS

| | | | | | |
|---|---|---|---|---|---|
| 2,949,520 | A | | 8/1960 | Schneider | |
| 3,089,936 | A | | 5/1963 | Smith, Jr. | |
| 3,522,399 | A | | 7/1970 | Crouch | |
| 3,809,836 | A | | 5/1974 | Crouch | |
| 3,836,740 | A | | 9/1974 | Hundstad | |
| 4,295,021 | A | * | 10/1981 | Asinovsky et al. | 218/34 |
| 4,390,762 | A | | 6/1983 | Watzke | |
| 4,445,015 | A | | 4/1984 | Zueckler | |
| 4,553,002 | A | * | 11/1985 | Slade | 218/128 |
| RE32,116 | E | | 4/1986 | Griesen | |
| 4,617,434 | A | * | 10/1986 | Zuckler | 218/127 |
| 4,636,600 | A | * | 1/1987 | Lipperts | 218/129 |
| 4,675,482 | A | | 6/1987 | Bialkowski | |
| 4,717,797 | A | | 1/1988 | Hoene | |
| 5,804,788 | A | | 9/1998 | Smith | |
| 6,080,952 | A | | 6/2000 | Okutomi et al. | |
| 6,426,475 | B2 | * | 7/2002 | Watanabe et al. | 218/118 |
| 6,891,121 | B2 | * | 5/2005 | Ren | 218/130 |
| 7,721,428 | B2 | | 5/2010 | Stoving et al. | |
| 7,906,742 | B2 | * | 3/2011 | Steffens et al. | 218/126 |

FOREIGN PATENT DOCUMENTS

| | | | |
|---|---|---|---|
| DE | 2527319 | A1 | 1/1976 |
| JP | 2011096474 | A | 5/2012 |

OTHER PUBLICATIONS

European Patent Office, "International Search Report and Written Opinion", Oct. 26, 2012.

* cited by examiner

*Primary Examiner* — Truc Nguyen
(74) *Attorney, Agent, or Firm* — Eckert Seamans Cherin & Mellott, LLC; Grant E. Coffield

(57) ABSTRACT

A hybrid switch assembly is provided for a vacuum switch, such as for example a vacuum interrupter. The vacuum interrupter includes a vacuum envelope, a fixed contact assembly partially within the vacuum envelope, and a movable contact assembly partially within the vacuum envelope and movable between a closed position in electrical contact with the fixed contact assembly and an open position spaced apart from the fixed contact assembly. The hybrid switch assembly includes at least one radial magnetic field generating mechanism, such as for example a spiral contact or cup member, and a number of axial magnetic field generating mechanisms each comprising a ferromagnetic or ferrimagnetic member, such as for example, a horseshoe plate assembly. Each axial magnetic field generating mechanism is disposed within the vacuum envelope proximate a corresponding radial magnetic field generating mechanism.

20 Claims, 8 Drawing Sheets

VACUUM SWITCH AND HYBRID SWITCH ASSEMBLY THEREFOR

BACKGROUND

1. Field

The disclosed concept relates to vacuum switching apparatus such as, for example, vacuum switches including a vacuum envelope such as, for example, vacuum interrupters. The disclosed concept also pertains to hybrid switch assemblies for vacuum interrupters.

2. Background Information

Vacuum interrupters include separable main contacts disposed within an insulated and hermetically sealed vacuum chamber. The vacuum chamber typically includes, for example and without limitation, a number of sections of ceramics (e.g., without limitation, a number of tubular ceramic portions) for electrical insulation capped by a number of end members (e.g., without limitation, metal components, such as metal end plates; end caps; seal cups) to form an envelope in which a partial vacuum may be drawn. The example ceramic section is typically cylindrical; however, other suitable cross-sectional shapes may be used. Two end members are typically employed. Where there are multiple ceramic sections, an internal center shield is disposed between the example ceramic sections.

Two types of vacuum interrupters include, for example, Radial Magnetic Field (RMF) vacuum interrupters, also commonly referred to as Transverse Magnetic Field (TMF) vacuum interrupters, and Axial Magnetic Field (AMF) vacuum interrupters. RMF vacuum interrupters typically include a radial magnetic field generating mechanism such as, for example and without limitation, a spiral contact (see, for example, U.S. Pat. Nos. 2,949,520; 3,522,399; and 3,809,836) or a contrate cup (see, for example, U.S. Pat. Nos. 3,089,936; 3,836,740; and 4,390,762). This structure is designed to force rotation of the arc column between the pair of electrical contacts interrupting a high current, thereby spreading the arcing duty over a relatively wide area. AMF vacuum interrupters, on the other hand, are typically structured to force current through a long coil-shaped path having a relatively significant circular rotational component in order to maintain the arc in a diffused state. See, for example, U.S. Pat. Nos. 5,804,788; 6,080,952; and 7,721,428.

Both RMF and AMF switch assemblies suffer from a number of disadvantages. For example, the single running columnar arc of RMF designs only spreads the arcing duty over the outer section of a normally circular shaped contact surface. Therefore, the heavy burning at the arc root of the single columnar arc carrying the entire short-circuit current eventually limits the dielectric recovery ability of the contact gap. With AMF vacuum interrupters, the continuous current carrying capability of the vacuum interrupter is limited due to the relatively long current path and corresponding electrical resistance to the current flow.

In an attempt to address the foregoing disadvantages, U.S. Pat. Nos. RE32,116 and 4,636,600, for example, disclose vacuum interrupters in which the axial magnetic field is generated, not by a long circular current flow path, but rather with strategic placement of ferromagnetic parts, such as a horseshoe assembly of magnetic plates.

U.S. Pat. Nos. 4,445,015; 4,553,002; 4,675,482; and 4,717,797, for example, disclose adding an axial magnetic field generating structure to a contrate cup type RMF structure, to provide enhanced high current interruption capability. However, such structures are complex and relatively large (e.g., tall in the axial direction). Moreover, the axial magnetic field is provided by manipulating the current flow along a relatively long path, resulting in substantial electric resistance of the vacuum interrupter.

There is, therefore, room for improvement in vacuum switches, such as vacuum interrupters, and in hybrid switch assemblies therefor.

SUMMARY

These needs and others are met by embodiments of the disclosed concept, which are directed to hybrid switch assemblies for vacuum switches, such as vacuum interrupters.

As one aspect of the disclosed concept, a hybrid switch assembly is provided for a vacuum switch. The vacuum switch comprises a vacuum envelope, a fixed contact assembly partially within the vacuum envelope, and a movable contact assembly partially within the vacuum envelope and movable between a closed position in electrical contact with the fixed contact assembly and an open position spaced apart from the fixed contact assembly. The hybrid switch assembly comprises: at least one radial magnetic field generating mechanism structured to be disposed within the vacuum envelope; and a number of axial magnetic field generating mechanisms each comprising a ferromagnetic or ferrimagnetic member structured to be disposed within the vacuum envelope proximate a corresponding one of the at least one radial magnetic field generating mechanism.

The ferromagnetic or ferrimagnetic member may be a horseshoe plate assembly. The radial magnetic field generating mechanism may be a spiral contact, wherein the spiral contact comprises a generally planar member having a center point, a periphery, and a plurality of slots extending inwardly from the periphery generally toward the center point. The radial magnetic field generating mechanism may alternatively be a cup member including a planar portion, a sidewall extending outwardly from the planar portion, and a plurality of slots disposed in the sidewall.

A vacuum switch employing the aforementioned hybrid switch assembly, is also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
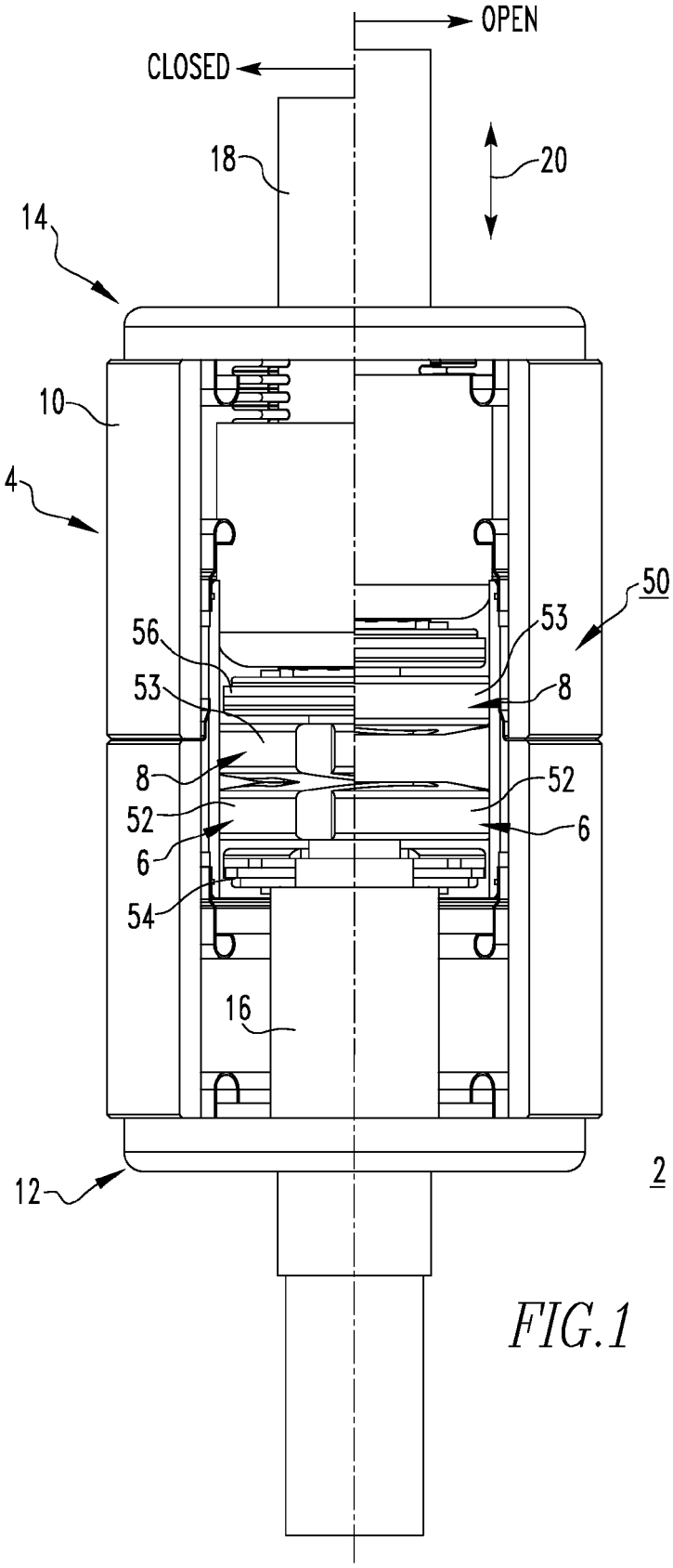
FIG. 1 is a side elevation partially in section view of vacuum interrupter and hybrid switch assembly therefor, in accordance with an embodiment of the disclosed concept, wherein the portion to the left of the vertical axis shows the closed position and the portion to the right of the vertical axis shows the open position.

The disclosed concept is described in association with vacuum interrupters, although the disclosed concept is applicable to a wide range of vacuum switches.

Directional phrases used herein, such as, for example, left, right, up, down and derivatives thereof, relate to the orientation of the elements shown in the drawings and are not limiting upon the claims unless expressly recited therein.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "vacuum envelope" means an envelope employing a partial vacuum therein.

As employed herein, the term "number" shall mean one or an integer greater than one (i.e., a plurality).

Referring to FIG. 1, a vacuum switch, such as a vacuum interrupter 2, is shown. The vacuum switch 2 includes a vacuum envelope 4, which is partially cut away in FIG. 1 to show hidden structures. A fixed contact assembly 6 is partially within the vacuum envelope 4. A movable contact assembly 8 is also partially within the vacuum envelope 4, and is movable (e.g., without limitation, up and down in the direction of arrow 20, from the perspective of FIG. 1) between a closed position (left side of the vertical axis of FIG. 1) in electrical contact with the fixed contact assembly 6, and an open position (right side of the vertical axis of FIG. 1) spaced apart from the fixed contact assembly 6. The major part of the vacuum envelope 4 is an insulating body 10.

Figure 2:
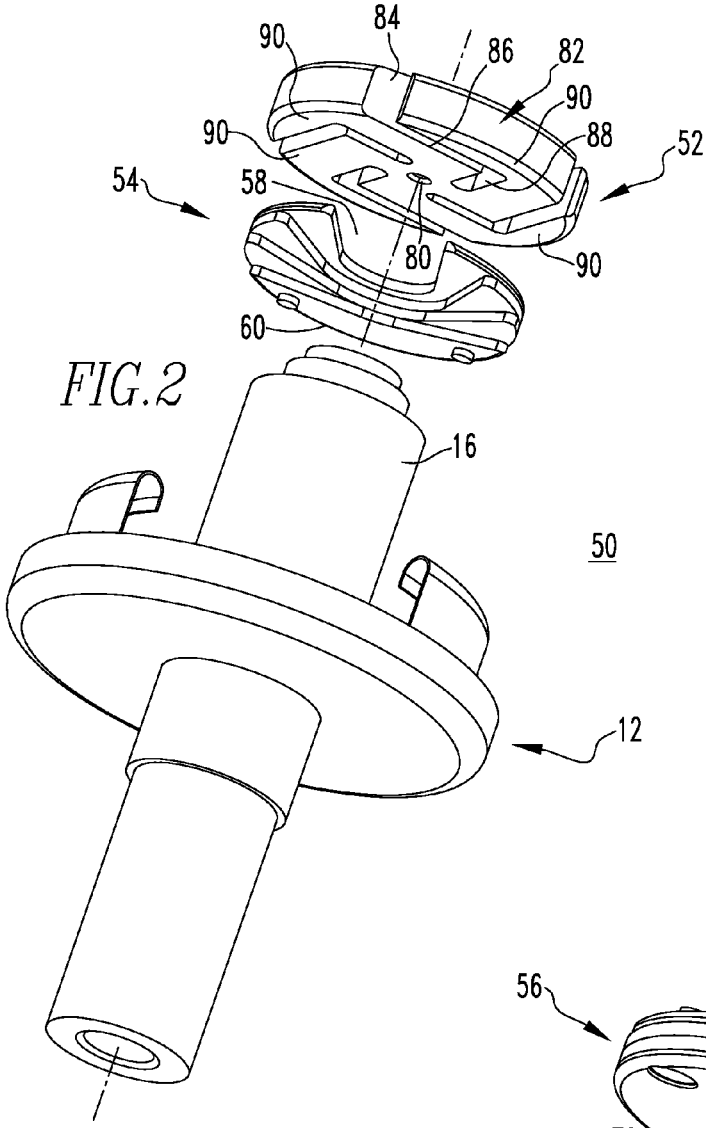
FIG. 2 is an exploded isometric view of the horseshoe plate assembly and spiral contact for the hybrid switch assembly of FIG. 1.
Figure 4:
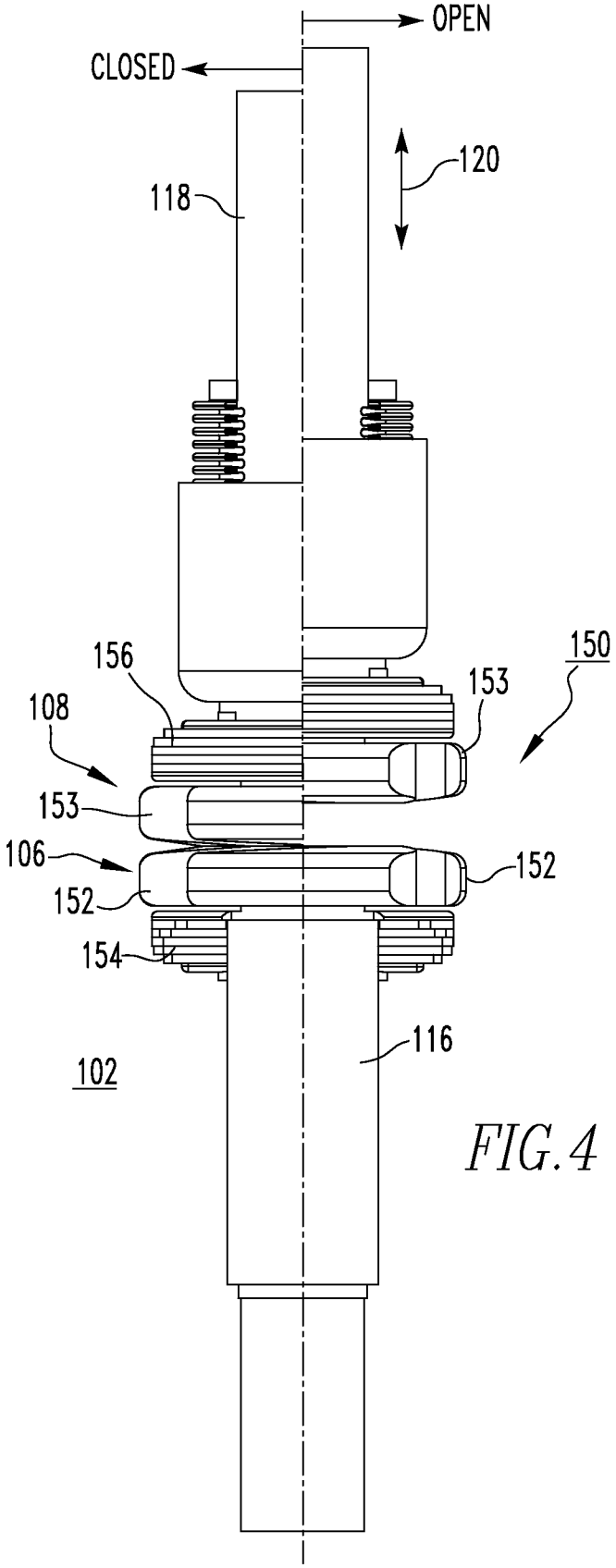
FIG. 4 is a side elevation view of a hybrid switch assembly in accordance with another embodiment of the disclosed concept, with the portion to the left of the vertical axis showing the closed position and the portion to the right of the vertical axis showing the open position.
Figure 7:
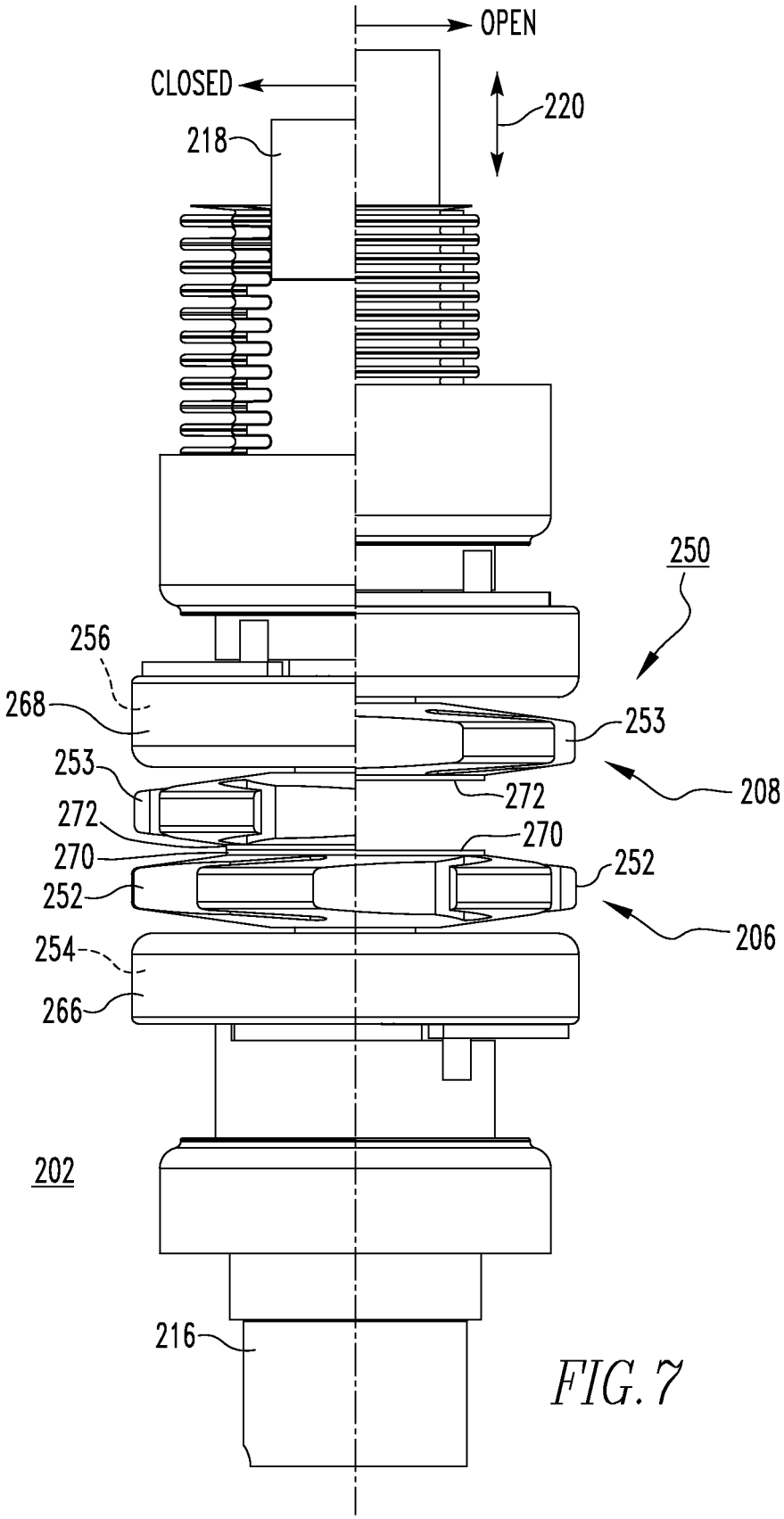
FIG. 7 is a side elevation view of a hybrid switch assembly in accordance with another embodiment of the disclosed concept, with the portion to the left of the vertical axis showing the closed position and the portion to the right of the vertical axis showing the open position.
Figure 10:
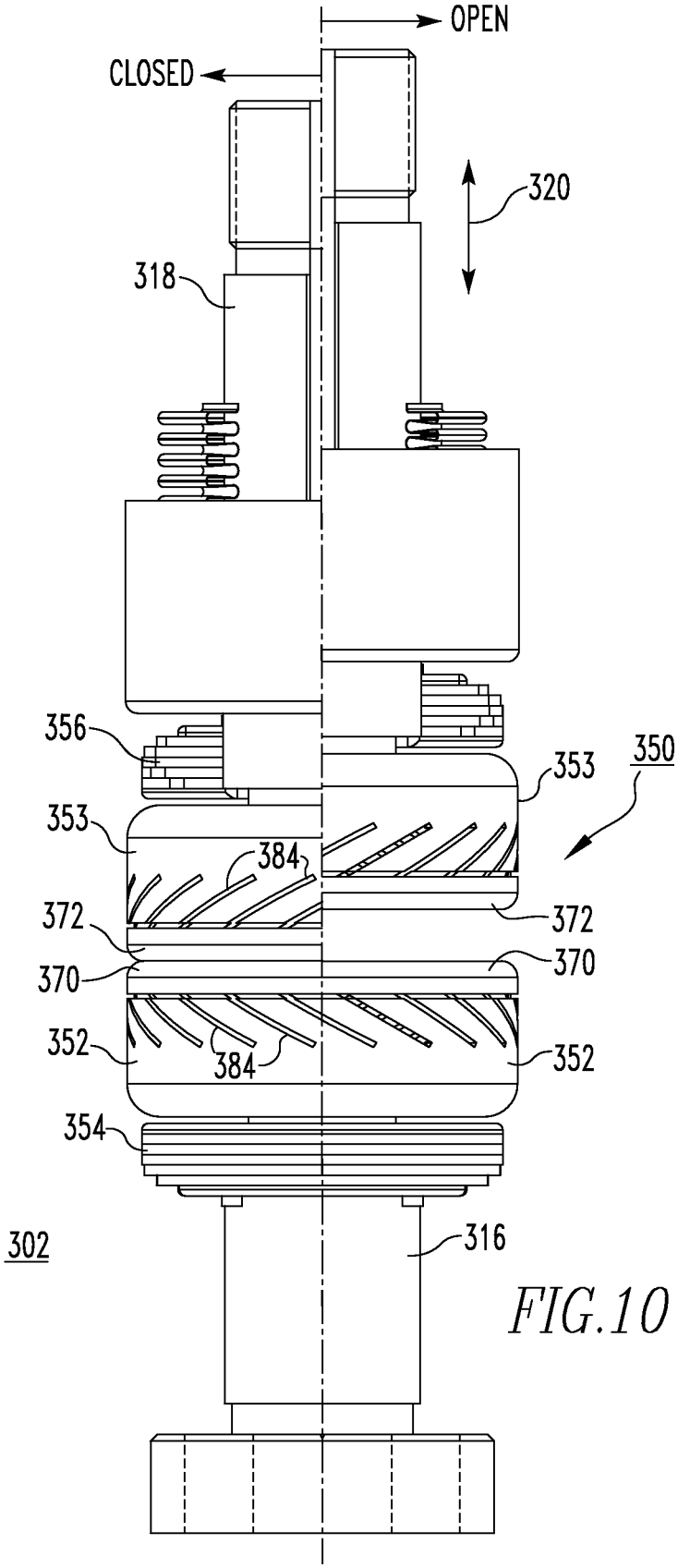
FIG. 10 is a side elevation view of a hybrid switch assembly in accordance with another embodiment of the disclosed concept, with the portion to the left of the vertical axis showing the closed position and the portion to the right of the vertical axis showing the open position.

Continuing to refer to FIG. 1, and also to FIG. 2, the vacuum switch 2, in accordance with the disclosed concept, includes a hybrid switch assembly 50 (see also, for example and without limitation, hybrid switch assemblies 150, 250 and 350 of FIGS. 4, 7 and 10, respectively). The hybrid switch assembly 50 includes at least one radial magnetic field generating mechanism 52 in combination with a number of axial field generating mechanisms 54,56. As shown in the cutaway view of FIG. 1, the radial magnetic field generating mechanisms 52,53 (two are shown in the non-limiting example of FIG. 1) and the axial magnetic field generating mechanisms 54,56 (two are shown in the non-limiting example of FIG. 1) are both disposed within the vacuum envelope 4. As will be described in greater detail hereinbelow, each of the axial magnetic field generating mechanisms 54,56 preferably comprises a ferromagnetic or ferrimagnetic member, which is structured to be disposed within the vacuum envelope 4 of the vacuum switch 2 proximate a corresponding one of the radial magnetic field generating mechanisms 52,53.

Figure 11:
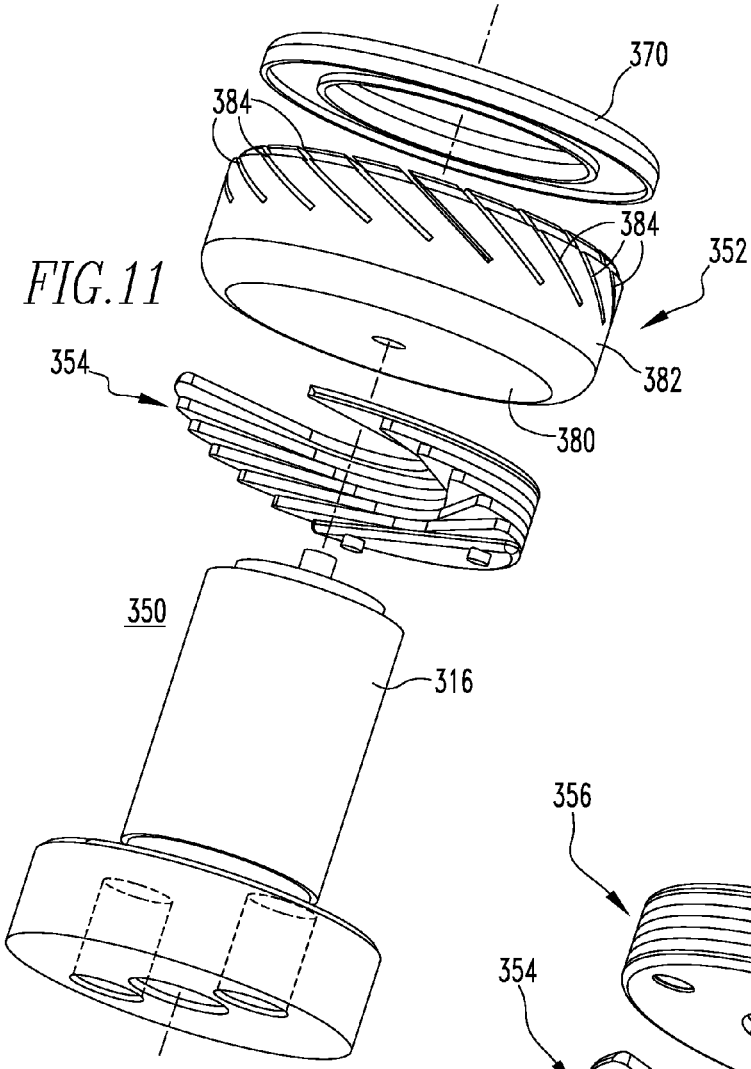
FIG. 11 is an exploded isometric view of a horseshoe plate assembly and contrate cup for the hybrid switch assembly of FIG. 10.

Among other benefits, combining both a radial magnetic field generating mechanism, in the form of either a number of spiral contacts 52,53 (FIG. 1), 152,153 (FIG. 4), 252,253 (FIG. 7) or a number of cup members (see, for example, contrate cups 352,353 of FIG. 10), and a number of axial magnetic field generating mechanisms, such as for example and without limitation horseshoe plate assemblies 54,56 (FIGS. 1 and 3), 154,156 (FIGS. 4 and 6), 254,256 (FIGS. 7 and 9), 354,356 (FIGS. 10 and 12) within the same vacuum interrupter 2 advantageously improves electric current interruption capability, exhibits relatively low electrical resistance, and is relatively simple to construct. More specifically, when such a hybrid switch assembly 50 (FIGS. 1 and 2), 150 (FIGS. 4 and 5), 250 (FIGS. 7 and 8), 350 (FIGS. 10 and 11) is provided, and arcing current is relatively low, the axial magnetic field of the hybrid switch assembly 50 maintains the arc in a diffused mode, evenly distributing the arcing duty over the contact surface. When the arcing current goes above a predetermined value during the arcing current cycle, and the arc forms into a constricted column, the radial magnetic field of the hybrid switch assembly 50 forces the arc column to move (e.g., spin) around the peripheral edge of the contact. In other words, by supplementing the radial magnetic field with the axial magnetic field, the arc does not remain in the constricted mode as long. Consequently, the arcing duty is effectively spread over the majority of the contact surface, and it is possible to break the single arc column into multiple smaller arc columns, thereby significantly reducing the momentary current density at the arc roots. This, in turn, substantially alleviates the intensity of arc damage and improves dielectric recovery of the contact gap immediately after a current zero. Accordingly, the hybrid switch assembly 50 in accordance with the disclosed concept provides for an advanced vacuum interrupter 2 capable of not only relatively high voltage, or relatively high current interruption, but also a relatively high continuous current carrying capability.

The hybrid switch assembly 50,150,250,350 of the disclosed concept will be further appreciated with reference to the following EXAMPLES, which will now be described with reference to FIGS. 1-12. It will be appreciated that the following EXAMPLES are provided solely for purposes of illustration, and are not intended to limit the scope of the disclosed concept.

EXAMPLE 1

The vacuum envelope 4 may comprise an insulating body 10 and first and second opposing ends or end members 12,14. The fixed contact assembly 6 may include a first stem member 16 extending through the first end 12 and into the vacuum envelope 4. The movable contact assembly 8 may include a second stem member 18 extending through the second end 14 and into the vacuum envelope 4. The radial magnetic field generating mechanism may include a first spiral contact 52 and a second spiral contact 53. The first spiral contact 52 is preferably disposed on the first stem member 16, and the second spiral contact 53 is preferably disposed on the second stem member 18. The second spiral contact 53 is movable, in the direction of arrow 20 of FIG. 1, between the closed and opened positions, shown.

EXAMPLE 2

Figure 3:
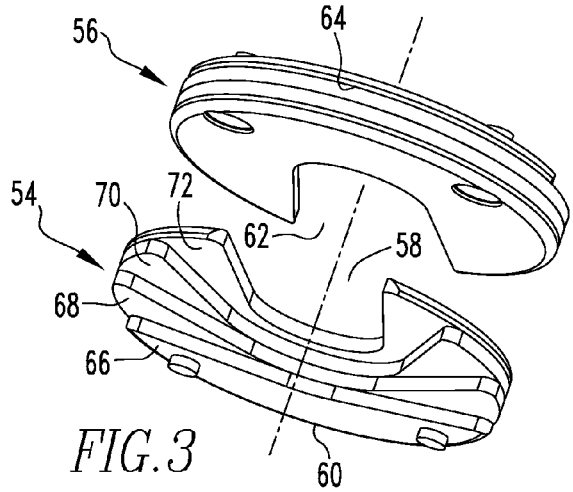
FIG. 3 is an exploded isometric view of the arrangement of the horseshoe plate assemblies of FIG. 1.

The axial magnetic field generating mechanisms may be a number of horseshoe plate assemblies 54,56, as shown for example in FIGS. 1 and 3. A first horseshoe plate assembly 54 may be disposed on the first stem member 16 between the first spiral contact 52 and the first end 12 of the vacuum envelope 4, and a second horseshoe plate assembly 56 may be disposed on the second stem member 18 between the second spiral contact 53 and the second end 14 of the vacuum envelope 4.

EXAMPLE 3

Each spiral contact 52 may have a center point 80, a periphery 82, and a plurality of slots 84 extending inwardly from the periphery 82 generally toward the center point 80. In the non-limiting example embodiment of FIG. 2, the spiral contact 52 includes four slots 84, each having a first leg portion 86 and a second leg portion 88 extending generally perpendicularly with respect to the first leg portion 86. The spiral contact 52 in the example of FIG. 2, therefore, includes four petals 90. It will be appreciated that the structure of the spiral contact 52, including but not limited to the number and/or configuration of the slots 84 and petals 90 thereof function to control the radial movement of the arc. It will further be appreciated that the spiral contact 52 could have any known or suitable alternative number and/or configuration of such structures, without departing from the scope of the disclosed concept.

EXAMPLE 4

Figure 5:
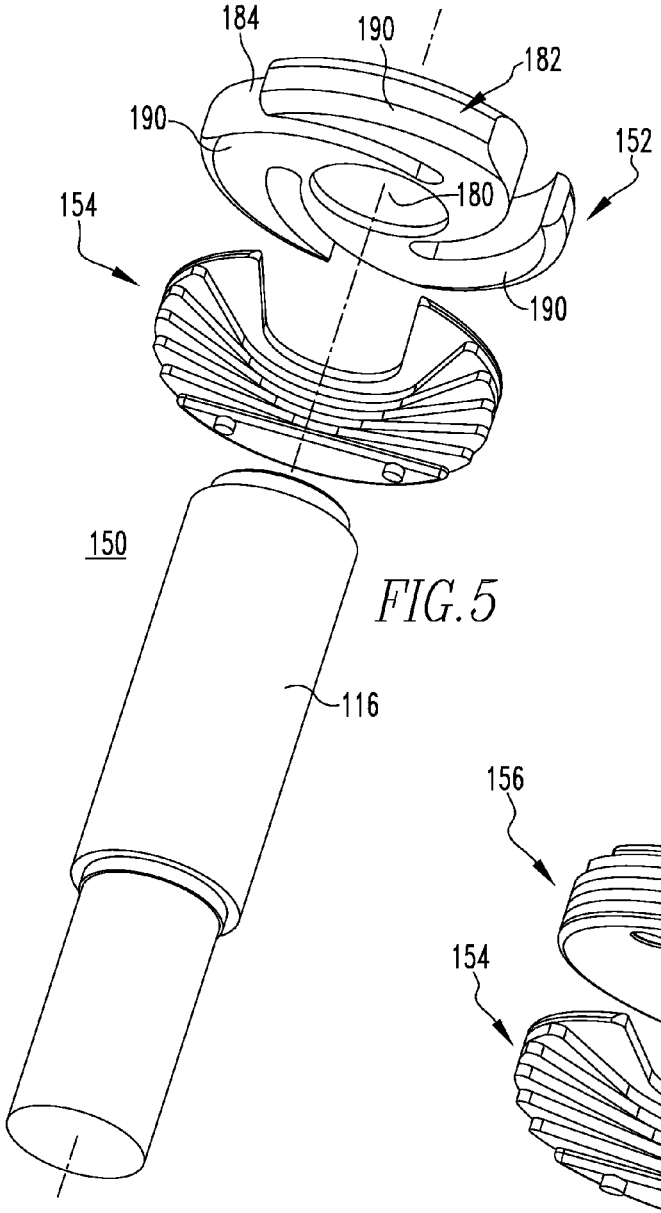
FIG. 5 is an exploded isometric view of the horseshoe plate assembly and spiral contact for the hybrid switch assembly of FIG. 4.

In the non-limiting example embodiment of FIG. 5, the spiral contact 152 includes three slots 184 extending inwardly from the periphery 182 of the spiral contact 152, generally toward the center point 180, thereby forming three petals 190.

EXAMPLE 5

Figure 8:
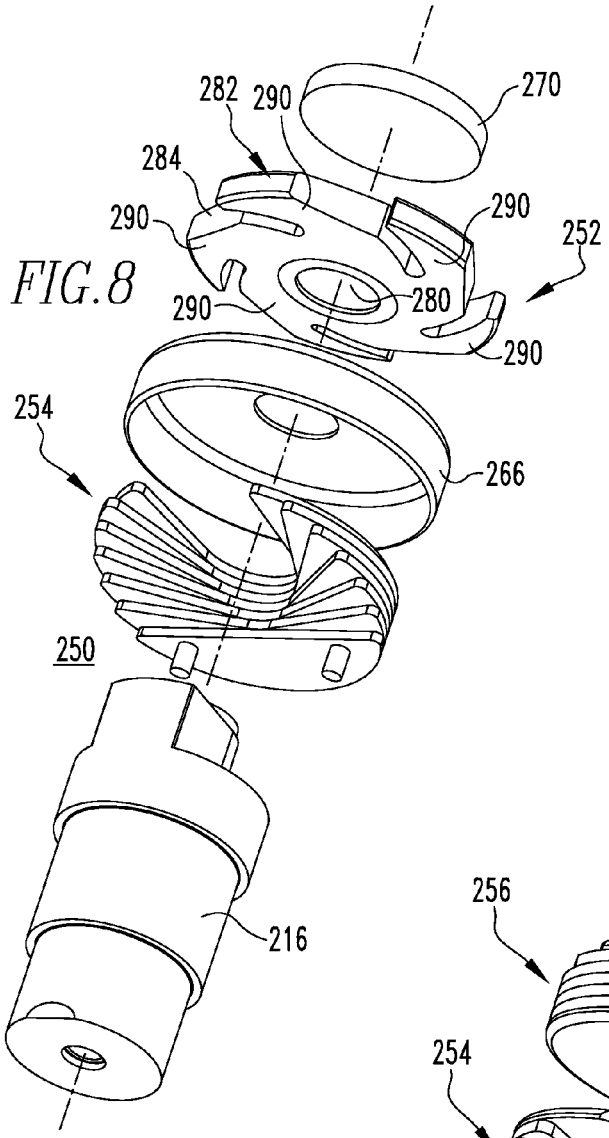
FIG. 8 is an exploded isometric view of a horseshoe plate assembly and spiral contact for the hybrid switch assembly of FIG. 7.

In the non-limiting example embodiment of FIG. 8, the spiral contact 252 includes five slots 284 extending inwardly from the periphery 282 of the spiral contact 252, generally toward the center point 280, thereby forming five petals 290.

EXAMPLE 6

Figure 6:
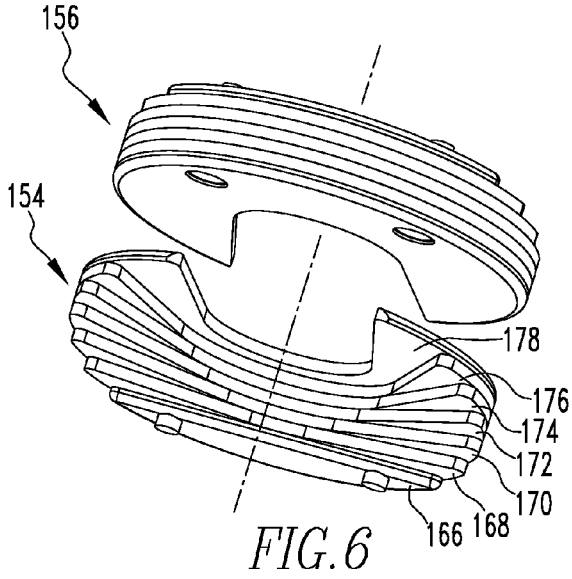
FIG. 6 is an exploded isometric view of the arrangement of the horseshoe plate assemblies of FIG. 4.
Figure 9:
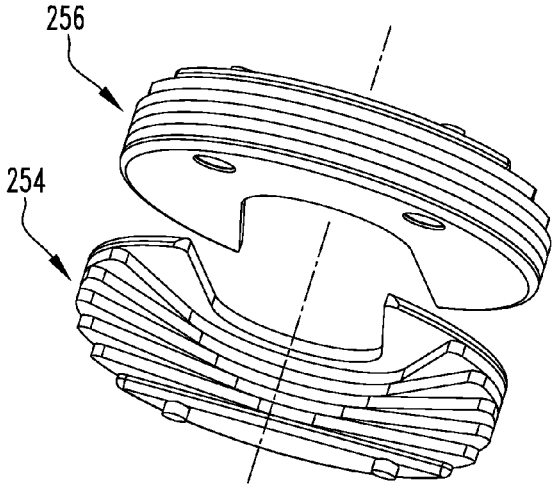
FIG. 9 is an exploded isometric view of the arrangement of the horseshoe plate assemblies of FIG. 7.
Figure 12:
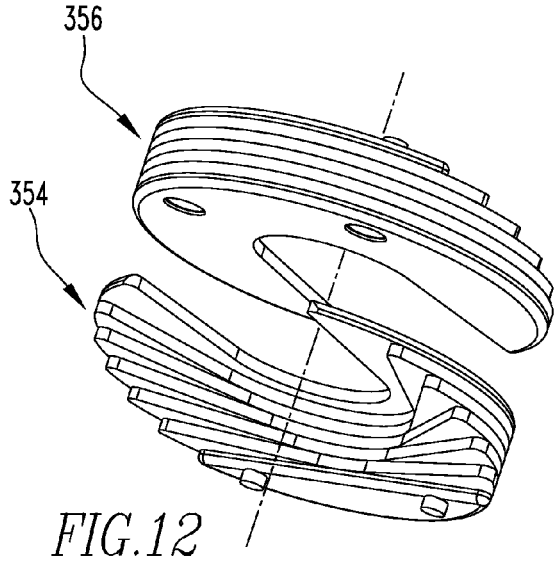
FIG. 12 is an exploded isometric view of the arrangement of the horseshoe plate assemblies of FIG. 10.

The first and second horseshoe plate assemblies 54,56 may respectfully include an open side 58,62, and a closed side 60,64 disposed generally opposite the open side 58,62, as shown in FIG. 3 (see also horseshoe plate assemblies 154,156 of FIG. 6, horseshoe plate assemblies 254,256 of FIG. 9, and horseshoe plate assemblies 354,356 of FIG. 12). The open side 58 of the first horseshoe plate assembly 54 may be disposed within the vacuum envelope 4 (FIG. 1) facing the opposite direction (e.g., rotated 180 degrees with respect to) as the open side 62 of the second horseshoe plate assembly 56, as shown in FIG. 3 (see also FIGS. 6, 9 and 12). More specifically, each of the horseshoe plate assemblies 154,156 is preferably substantially identical, and are arranged across from one another and symmetrical about a vertical longitudinal axis, as shown in FIG. 6. As also shown in FIG. 6 (see also FIGS. 3, 9 and 12), the horseshoe plate assemblies 154,156 are also preferably inverted with respect to one another. That is, the individual plate members (see, for example, plate members 66,68,70,72 of horseshoe plate assembly 54 of FIG. 3) are preferably arranged in a stepped pattern and gradually increasing in size, as shown.

EXAMPLE 7

Each horseshoe plate assembly may include any known or suitable number and/or configuration of individual plate members. For example and without limitation, in the non-limiting example embodiment of FIG. 3, horseshoe plate assembly 54 includes four plate members 66,68,70,72 arranged in a stepped pattern, as shown.

EXAMPLE 8

The horseshoe plate assemblies 154,156 may alternatively have up to seven or more plate members 166,168,170,172, 174,176,178, as shown for example in the non-limiting example embodiment of FIG. 6.

EXAMPLE 9

The hybrid switch assembly 250 may further comprise a suitable number and configuration of recessed members, such as for example and without limitation, the first recessed member 266 and second recessed member 268, shown in FIG. 7 (see also recessed member 266 of FIG. 8). The first recessed member 266 may be disposed between the first spiral contact 252 and the first horseshoe plate assembly 254, and the second recessed member 268 may be disposed between the second spiral contact 253 and the second horseshoe plate assembly 256. The first horseshoe assembly 254 is preferably disposed substantially within the first recessed member 266, and the second horseshoe plate assembly 256 is preferably disposed substantially within the second recessed member 268, as shown in hidden line drawing in FIG. 7.

EXAMPLE 10

The hybrid switch assembly 250 may further comprise a first contact member 270 (FIGS. 7 and 8) and a second contact member 272 (FIG. 7). The first contact member 270 is disposed on the fixed contact assembly 206, and the second contact member 272 is disposed on the movable contact assembly 208. Accordingly, the second contact member 272 is movable in the direction of arrow 220 of FIG. 7, into and out of electrical contact with the first contact member 270. See also, for example and without limitation, second contact member 372 movable in the direction of arrow 320 of FIG. 10, into and out of electrical contact with first contact member 370.

EXAMPLE 11

It will be appreciated that the radial magnetic field generating mechanism may alternatively comprise a cup member, such as for example and without limitation, the contrate cups 352,353, shown in FIG. 10. Each cup member 352 includes a planar portion 380, a side wall 382 extending outwardly from the planar portion 380, and a plurality of slots 384 disposed in the side wall 382 (best shown in FIG. 11). It will be appreciated that the slots 384 are structured to suitably control the movement (e.g., spinning; rotation) of the arc (not shown). It will further be appreciated that the cup member(s) (e.g., 352, 353) may have any known or suitable alternative number and/or configuration of slots other than that which is shown and described herein, without departing from the scope of the disclosed concept.

Accordingly, the disclosed concept provides a hybrid switch assembly 50 (FIGS. 1 and 2), 150 (FIGS. 4 and 5), 250 (FIGS. 7 and 8), 350 (FIGS. 10 and 11) that employs the combination of radial magnetic field generating mechanisms 52,53 (FIGS. 1 and 2), 152,153 (FIGS. 4 and 5), 252,253 (FIGS. 7 and 8), 352,353 (FIGS. 10 and 11) and axial magnetic field generating mechanisms 54,56 (FIGS. 1 and 3), 154,156 (FIGS. 4 and 6), 254,256 (FIGS. 7 and 9), 354,356 (FIGS. 10 and 12) to effectively provide a vacuum switch 2 (FIG. 1) capable of not only relatively high voltage, high current interruption, but which also has a relatively high continuous current carrying capability.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A hybrid switch assembly for a vacuum switch, said vacuum switch comprising a vacuum envelope, a fixed contact assembly partially within said vacuum envelope, and a movable contact assembly partially within said vacuum envelope and movable between a closed position in electrical contact with the fixed contact assembly and an open position spaced apart from the fixed contact assembly, said hybrid switch assembly comprising:

at least one radial magnetic field generating mechanism structured to be disposed within said vacuum envelope; and a number of axial magnetic field generating mechanisms each comprising a ferromagnetic or ferrimagnetic member structured to be disposed within said vacuum envelope proximate a corresponding one of said at least one radial magnetic field generating mechanism, wherein said at least one radial magnetic field generating mechanism and said number of axial magnetic field generating mechanisms are combined together within the same vacuum switch.

2. The hybrid switch assembly of claim 1 wherein said ferromagnetic or ferrimagnetic member is a horseshoe plate assembly.

3. The hybrid switch assembly of claim 2 wherein said at least one radial magnetic field generating mechanism is at least one spiral contact; and wherein said at least one spiral contact comprises a generally planar member having a center point, a periphery, and a plurality of slots extending inwardly from the periphery generally toward the center point.

4. The hybrid switch assembly of claim 3 wherein said vacuum envelope comprises an insulating body and a first end and a second end disposed opposite and distal from the first end; wherein said fixed contact assembly comprises a first stem member extending through said first end and into said vacuum envelope; wherein said movable contact assembly comprises a second stem member extending through said second end and into said vacuum envelope; wherein said at least one spiral contact is a first spiral contact and a second spiral contact; wherein said first spiral contact is structured to be disposed on said first stem member; and wherein said second spiral contact is structured to be disposed on said second stem member.

5. The hybrid switch assembly of claim 4 wherein said number of axial magnetic field generating mechanisms is a first horseshoe plate assembly and a second horseshoe plate assembly; wherein said first horseshoe plate assembly is structured to be disposed on said first stem member between said first spiral contact and the first end of said vacuum envelope; and wherein said second horseshoe plate assembly is structured to be disposed on said second stem member between said second spiral contact and the second end of said vacuum envelope.

6. The hybrid switch assembly of claim 5 wherein said first horseshoe plate assembly and said second horseshoe plate assembly each include an open side and a closed side; and wherein the open side of said first horseshoe plate assembly faces the opposite direction as the open side of said second horseshoe plate assembly.

7. The hybrid switch assembly of claim 5 further comprising a first recessed member and a second recessed member; wherein said first recessed member is disposed between said first spiral contact and said first horseshoe plate assembly; and wherein said second recessed member is disposed between said second spiral contact and said second horseshoe plate assembly.

8. The hybrid switch assembly of claim 7 wherein said first horseshoe plate assembly is disposed substantially within said first recessed member; and wherein said second horseshoe plate assembly is disposed substantially within said second recessed member.

9. The hybrid switch assembly of claim 2 further comprising a first contact member and a second contact member; wherein said first contact member is structured to be disposed on said fixed contact assembly; wherein said second contact member is structured to be disposed on said movable contact assembly; and wherein said second contact member is movable into and out of electrical contact with said first contact member.

10. The hybrid switch assembly of claim 2 wherein said at least one radial magnetic field generating mechanism is at least one cup member; and wherein said at least one cup member includes a planar portion, a sidewall extending outwardly from said planar portion, and a plurality of slots disposed in said sidewall.

11. A vacuum switching apparatus comprising:

a vacuum envelope;

a fixed contact assembly partially within said vacuum envelope;

a movable contact assembly partially within said vacuum envelope and movable between a closed position in electrical contact with the fixed contact assembly and an open position spaced apart from the fixed contact assembly; and a hybrid switch assembly comprising:

at least one radial magnetic field generating mechanism disposed within said vacuum envelope, and a number of axial magnetic field generating mechanisms each comprising a ferromagnetic or ferrimagnetic member disposed within said vacuum envelope proximate a corresponding one of said at least one radial magnetic field generating mechanism, wherein said at least one radial magnetic field generating mechanism and said number of axial magnetic field generating mechanisms are combined together within the same vacuum switch.

12. The vacuum switching apparatus of claim 11 wherein said ferromagnetic or ferrimagnetic member is a horseshoe plate assembly.

13. The vacuum switching apparatus of claim 12 wherein said at least one radial magnetic field generating mechanism of said hybrid switch assembly is at least one spiral contact; and wherein said at least one spiral contact comprises a generally planar member having a center point, a periphery, and a plurality of slots extending inwardly from the periphery generally toward the center point.

14. The vacuum switching apparatus of claim 13 wherein said vacuum envelope comprises an insulating body and a first end and a second end disposed opposite and distal from the first end; wherein said fixed contact assembly comprises a first stem member extending through said first end and into said vacuum envelope; wherein said movable contact assembly comprises a second stem member extending through said second end and into said vacuum envelope; wherein said at least one spiral contact is a first spiral contact and a second spiral contact; wherein said first spiral contact is disposed on said first stem member; and wherein said second spiral contact is disposed on said second stem member.

15. The vacuum switching apparatus of claim 14 wherein said number of axial magnetic field generating mechanisms is a first horseshoe plate assembly and a second horseshoe plate assembly; wherein said first horseshoe plate assembly is disposed on said first stem member between said first spiral contact and said first end; and wherein said second horseshoe plate assembly is disposed on said second stem member between said second spiral contact and said second end.

16. The vacuum switching apparatus of claim 15 wherein said first horseshoe plate assembly and said second horseshoe plate assembly each include an open side and a closed side; and wherein the open side of said first horseshoe plate assembly faces the opposite direction as the open side of said second horseshoe plate assembly.

17. The vacuum switching apparatus of claim 15 further comprising a first recessed member and a second recessed member; wherein said first recessed member is disposed between said first spiral contact and said first horseshoe plate assembly; and wherein said second recessed member is disposed between said second spiral contact and said second horseshoe plate assembly.

18. The vacuum switching apparatus of claim 17 wherein said first horseshoe plate assembly is disposed substantially within said first recessed member; and wherein said second horseshoe plate assembly is disposed substantially within said second recessed member.

19. The vacuum switching apparatus of claim 12 further comprising a first contact member and a second contact member; wherein said first contact member is disposed on said fixed contact assembly; wherein said second contact member is disposed on said movable contact assembly; and wherein said second contact member is movable into and out of electrical contact with said first contact member.

20. The vacuum switching apparatus of claim 12 wherein said at least one radial magnetic field generating mechanism is at least one cup member; and wherein said at least one cup member includes a planar portion, a sidewall extending outwardly from said planar portion, and a plurality of slots disposed in said sidewall.

* * * * *